US008220220B2

(12) United States Patent
Kim et al.

(10) Patent No.: US 8,220,220 B2
(45) Date of Patent: Jul. 17, 2012

(54) REINFORCEMENT METHOD AND REINFORCEMENT STRUCTURE OF THE CORRUGATED STEEL PLATE STRUCTURE

(75) Inventors: Hyeon-Kuk Kim, Jeollanam-do (KR); Byung-Gun Jung, Gyeonggi-do (KR); Seung-Ho Kim, Gyeonggi-do (KR)

(73) Assignee: Fixon E&C Co., Ltd, Seoul (KR)

( * ) Notice: Subject to any disclaimer, the term of this patent is extended or adjusted under 35 U.S.C. 154(b) by 480 days.

(21) Appl. No.: 12/094,531

(22) PCT Filed: Dec. 19, 2006

(86) PCT No.: PCT/KR2006/005553

§ 371 (c)(1),
(2), (4) Date: Jun. 5, 2008

(87) PCT Pub. No.: WO2007/073075

PCT Pub. Date: Jun. 28, 2007

(65) Prior Publication Data

US 2008/0307744 A1 Dec. 18, 2008

(30) Foreign Application Priority Data

Dec. 20, 2005 (KR) ..... 10-2005-0126284
Dec. 20, 2005 (KR) ..... 20-2005-0035818 U

(51) Int. Cl.
*E04C 2/32* (2006.01)

(52) U.S. Cl. ..... 52/745.07; 52/80.1; 52/82; 52/742.14

(58) Field of Classification Search ..... 52/80.1, 52/81.4, 81.6, 82, 85, 86, 88, 319, 329, 330, 52/339, 745.07, 742.14; 29/897, 897.3, 897.34, 29/525.01, 525.02, 527.1, 527.2; 264/31–35; 405/124–126

See application file for complete search history.

(56) References Cited

U.S. PATENT DOCUMENTS 1,625,838 A * 4/1927 White ..... 52/682
2,024,727 A * 12/1935 Finley et al. ..... 442/71
2,223,418 A * 12/1940 Hewett ..... 52/81.4
2,612,675 A * 10/1952 Wread ..... 264/34
3,180,459 A * 4/1965 Liskey, Jr. ..... 52/474

(Continued)

FOREIGN PATENT DOCUMENTS

CA 862402 A 2/1971

(Continued)

*Primary Examiner* — Brian Glessner
*Assistant Examiner* — Adam Barlow
(74) *Attorney, Agent, or Firm* — Levine & Mandelbaum

(57) ABSTRACT

The present invention relates to a method and structure for reinforcing a corrugated steel plate structure. The present invention provides a method of reinforcing a corrugated steel plate structure using a liner provided on one surface of a corrugated steel plate, the reinforcing method using the liner comprising: an anchor bolt installing step of forming an anchor bolt insert hole in the surface of the corrugated steel plate and installing an anchor bolt in the anchor bolt insert hole such that the upper end of the anchor bolt protrudes from the surface of the corrugated steel plate to a predetermined height; a reinforcing bar installing step of fastening a reinforcing bar to the anchor bolt using a wire; a mold installing step of mounting a mold to the anchor bolt using a nut such that the reinforcing bar is covered with the mold; a concrete placing step of placing concrete inside the mold; and a mold removing step of removing the mold after the placed concrete has been cured.

2 Claims, 4 Drawing Sheets

U.S. PATENT DOCUMENTS

| | | | | | |
|---|---|---|---|---|---|
| 3,197,933 | A | * | 8/1965 | Burns et al. | 52/538 |
| 3,508,406 | A | * | 4/1970 | Fisher | 405/124 |
| 3,967,426 | A | * | 7/1976 | Ault et al. | 52/252 |
| 4,388,791 | A | * | 6/1983 | Anderson | 52/719 |
| 4,390,306 | A | * | 6/1983 | Fisher | 405/124 |
| 4,563,107 | A | * | 1/1986 | Peterson | 405/124 |
| 4,631,881 | A | * | 12/1986 | Charman | 52/220.7 |
| 5,326,191 | A | | 7/1994 | Wilson | |
| 5,746,034 | A | * | 5/1998 | Luchetti et al. | 52/220.7 |
| 5,746,035 | A | * | 5/1998 | Seiber et al. | 52/238.1 |
| 5,833,394 | A | | 11/1998 | McCavour | |
| 5,881,460 | A | * | 3/1999 | Nowell et al. | 29/897.34 |
| 6,012,258 | A | * | 1/2000 | Brown et al. | 52/239 |
| 6,675,382 | B1 | * | 1/2004 | Foster | 717/177 |
| 7,017,311 | B2 | * | 3/2006 | Weiss | 52/271 |
| 7,461,484 | B2 | * | 12/2008 | Battey et al. | 52/220.7 |
| 7,861,346 | B2 | * | 1/2011 | Wilson | 14/24 |
| 2004/0035704 | A1 | * | 2/2004 | Kohler | 204/618 |
| 2006/0059806 | A1 | * | 3/2006 | Gosling et al. | 52/238.1 |
| 2008/0295426 | A1 | * | 12/2008 | Milligan et al. | 52/238.1 |

FOREIGN PATENT DOCUMENTS

| | | | |
|---|---|---|---|
| DE | 2657229 | A1 | 7/1977 |
| EP | 0057082 | A2 | 8/1982 |
| FR | 2508072 | A1 | 12/1982 |
| KR | 20-0167832 | Y1 | 2/2000 |
| KR | 10-2003-0053637 | A | 7/2003 |
| WO | 9747825 | A1 | 12/1997 |

* cited by examiner

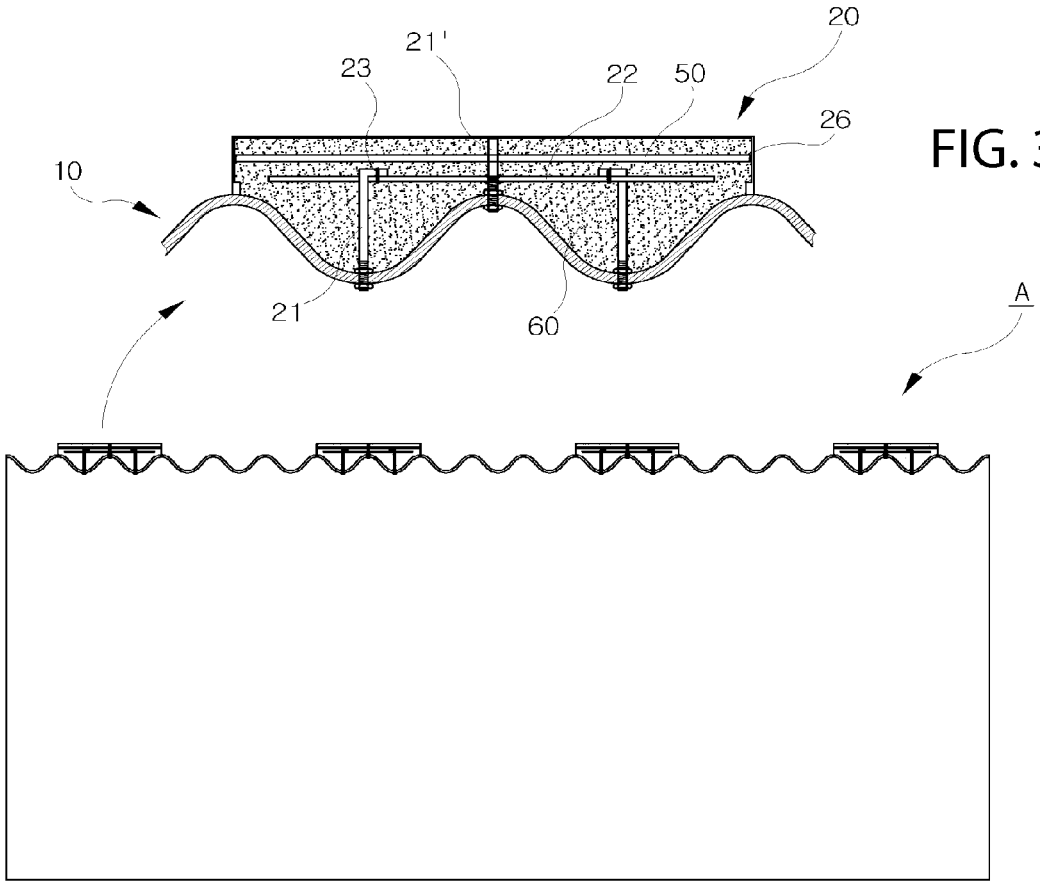
FIG. 3
FIG. 4
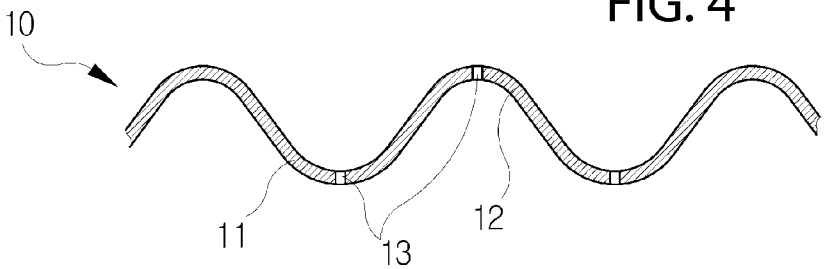
FIG. 5
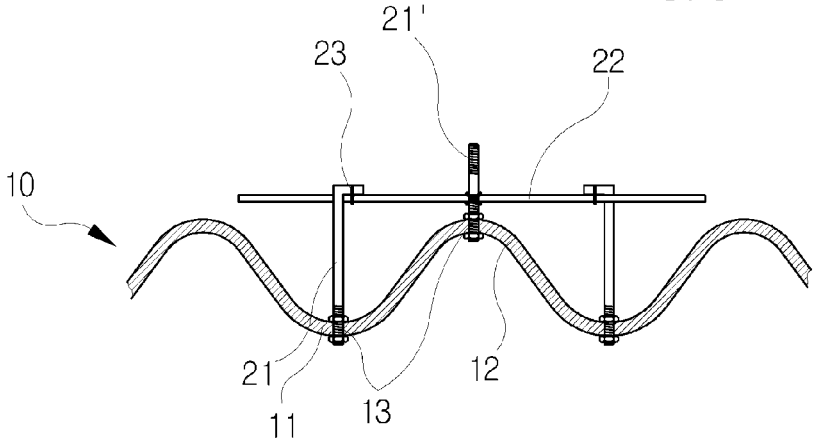

REINFORCEMENT METHOD AND REINFORCEMENT STRUCTURE OF THE CORRUGATED STEEL PLATE STRUCTURE

TECHNICAL FIELD

The present invention relates, in general, to a method and structure for reinforcing a corrugated steel plate structure and, more particularly, to a reinforcement method and reinforcement structure, in which a liner having a predetermined width and height is provided on one surface of a corrugated steel plate constituting a corrugated steel plate structure having a span of at least 15 m, thus increasing the axial strength and bending strength of the steel plate structure, enhancing the industrial usefulness of the structure, reducing the number of construction steps and the number of steps for processing the liner, thus reducing the construction time and the construction cost.

BACKGROUND ART

Generally, to fabricate a corrugated steel plate structure, which has been variously used as a material of an underground passage, an irrigation channel, a drain, an embankment cell, a bank revetment drain, a roof, or a warehouse, a plurality of steel plates having predetermined thickness and width are bent and formed into various shapes, and are assembled with each other in an axial direction to form a tunnel shape.

When the size of a desired corrugated steel plate structure is small, one corrugated steel plate which has been subjected to a bending process may be used. However, when the size of a desired corrugated steel plate structure increases, a plurality of corrugated steel plates, which have been separately subjected to respective bending processes with high bending ratios, are used such that the steel plates overlap and are assembled with each other through an assembly process, such as a bolting process, thus producing a desired structure.

Further, in an effort to increase the load carrying capacity of a thin steel plate by evenly distributing a load or shock, which is applied to the thin steel plate in a side direction, a latitudinal direction, a longitudinal direction or any direction, to surrounding areas, the thin steel plate is preferably subjected to a crimping process, thus forming a corrugated steel plate having alternating furrows and ridges.

To construct a structure using the corrugated steel plates, the ground on which the structure is supported is dug to a predetermined depth for laying the foundation. After laying the foundation, molds and reinforcing bars are arranged. Thereafter, anchors and a channel are laid, and concrete is placed prior to curing the concrete. After the concrete has been completely cured, the molds are removed from the channel.

After removing the molds from the channel, a plurality of first corrugated steel plates is fixed in the channel using locking members, such as bolts and nuts, such that the lower ends of the first steel plates are perpendicular to the channel. Thereafter, second corrugated steel plates are bolted to the first corrugated steel plates at locations between the first corrugated steel plates, thus forming a desired corrugated steel plate structure.

However, the conventional corrugated steel plate, constituting the corrugated steel plate structure, is produced through a crimping process, in which a thin steel plate is crimped to form alternating furrows and ridges that extend parallel to each other. Thus, when the corrugated steel plate is used in a short structure, the corrugated steel plate may be successfully used. However, when the corrugated steel plate is used in a long structure having a span of at least 15 m, the corrugated steel plate structure has a reduced longitudinal sectional area. Thus, the resistance of the structure against the compressive force is reduced, and thus part of the structure may be easily broken.

To solve the above-mentioned problems, H-beams or ribs may be installed outside the corrugated steel plate, thus reinforcing the structure. However, to install an H-beam or a rib outside a corrugated steel plate, the H-beam or the rib is suspended over the corrugated steel plate using a crane, and workers must conduct manual work, such as bolting work, thus being excessively time-consuming and expensive. Further, because the corrugated steel plate has a reduced longitudinal sectional area, the same problem as that described above occurs.

DISCLOSURE

Technical Problem

Accordingly, the present invention has been made keeping in mind the above problems occurring in the related art, and an object of the present invention is to provide a method and structure for reinforcing a corrugated steel plate structure, in which a liner having a predetermined width and height is provided along the outer surface of a corrugated steel plate constituting a corrugated steel plate structure, thus increasing the axial strength and bending strength of the steel plate structure, so that the corrugated steel plate can be safely used in a structure having a span of at least 15 m, enhances the industrial usefulness of the structure, reduces the number of construction steps and the number of steps for processing the liner, and thus reduces the construction time and the construction cost.

Technical Solution

In order to accomplish the above object, in an aspect, the present invention provides a method of reinforcing a corrugated steel plate structure using a liner provided on one surface of a corrugated steel plate, the reinforcing method using the liner comprising: an anchor bolt installing step S10 of forming an anchor bolt insert hole in the surface of the corrugated steel plate and installing an anchor bolt in the anchor bolt insert hole such that the upper end of the anchor bolt protrudes from the surface of the corrugated steel plate to a predetermined height; a reinforcing bar installing step S20 of fastening a reinforcing bar to the anchor bolt, which protrudes from the surface of the corrugated steel plate, using a wire; a mold installing step S30 of mounting a mold to the anchor bolt using a nut such that the reinforcing bar, which has been installed above the surface of the corrugated steel plate, is covered by the mold; a concrete placing step S40 of placing concrete inside the mold, which has been installed on the surface of the corrugated steel plate; and a mold removing step S50 of removing the mold after the concrete, which has been placed inside the mold, has been cured.

Further, in the method of reinforcing the corrugated steel plate structure, the mold installing step S30 may comprise: placing a seal 40 between the mold 30, which has been mounted on the surface of the corrugated steel plate 10, and the surface of the corrugated steel plate 10; and reinforcing the mold 30, which has been mounted on the surface of the corrugated steel plate 10, using a support bar 50 having externally-threaded parts 51 formed on opposite ends of the support bar 50 and engaging with respective locking nuts 52.

Further, in another aspect, the present invention provides a structure for reinforcing a corrugated steel plate structure A using a liner 20 provided on one surface of a corrugated steel plate 10, the reinforcing structure using the liner 20 comprising: an anchor bolt insert hole 13 formed in each of a furrow 11 and a ridge 12 of the corrugated steel plate 10; an anchor bolt 21, 21', which is mounted to each of the anchor bolt insert holes 13 such that the lower end of the anchor bolt 21, 21' is securely mounted to the anchor bolt insert hole 13 and an upper end of the anchor bolt protrudes outside the corrugated steel plate 10 to a predetermined length; concrete 60, which has been placed and cured along the outer surface of the corrugated steel plate 10 having the protruding anchor bolt 21, 21' such that the concrete 60 has a predetermined width and height; a reinforcing bar 22 fastened to the anchor bolts 21 and 21' using a wire 23 inside the concrete 60; a support bar 50 securely placed inside the cured concrete 60 at a position above the reinforcing bar 22, thus being fixed by the cured concrete 60; and a waterproof paint 26 applied to the exterior surface of the concrete 60 to a predetermined thickness.

Advantageous Effects

As described above, the present invention provides a concrete liner, which has a predetermined width and height and is formed along the outer surface of a corrugated steel plate constituting a corrugated steel plate structure, thus increasing the sectional area of the structure and increasing the axial strength and the bending strength of the structure, so that the corrugated steel plate can be safely used in a structure having a span of at least 15 m, thus enhancing the industrial usefulness of the structure.

Further, the present invention reduces the number of construction steps and the number of steps for processing the liner, and thus reduces the construction time and the construction cost.

DESCRIPTION OF DRAWINGS

FIG. 3 is a sectional view of FIG. 2; and

FIGS. 4 through 8 are views illustrating the sequential steps of the method of reinforcing the corrugated steel plate structure according to the present invention.

BEST MODE

Figure 1:
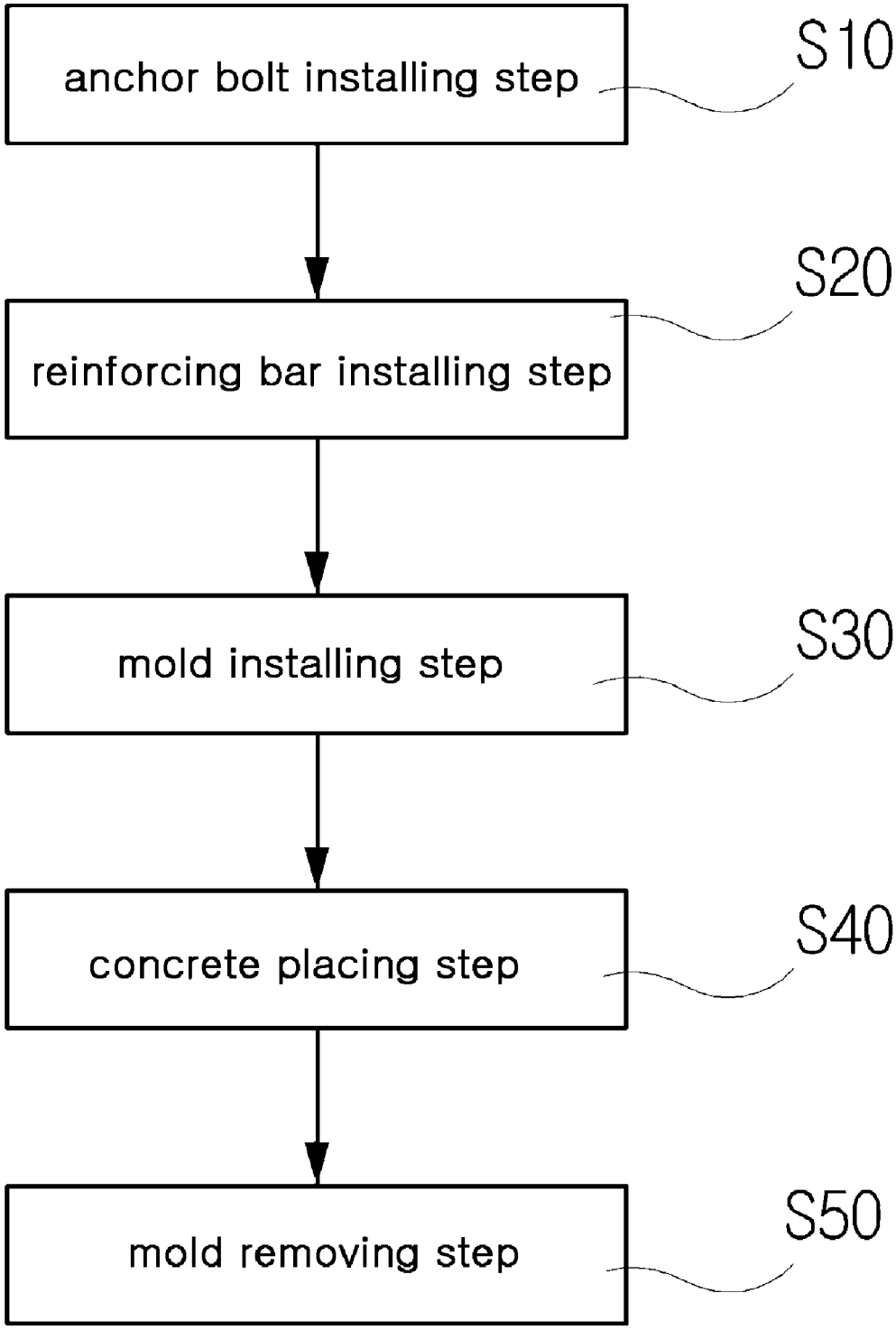
FIG. 1 is a flowchart of the method of reinforcing a corrugated steel plate structure according to the present invention.
Figure 2:
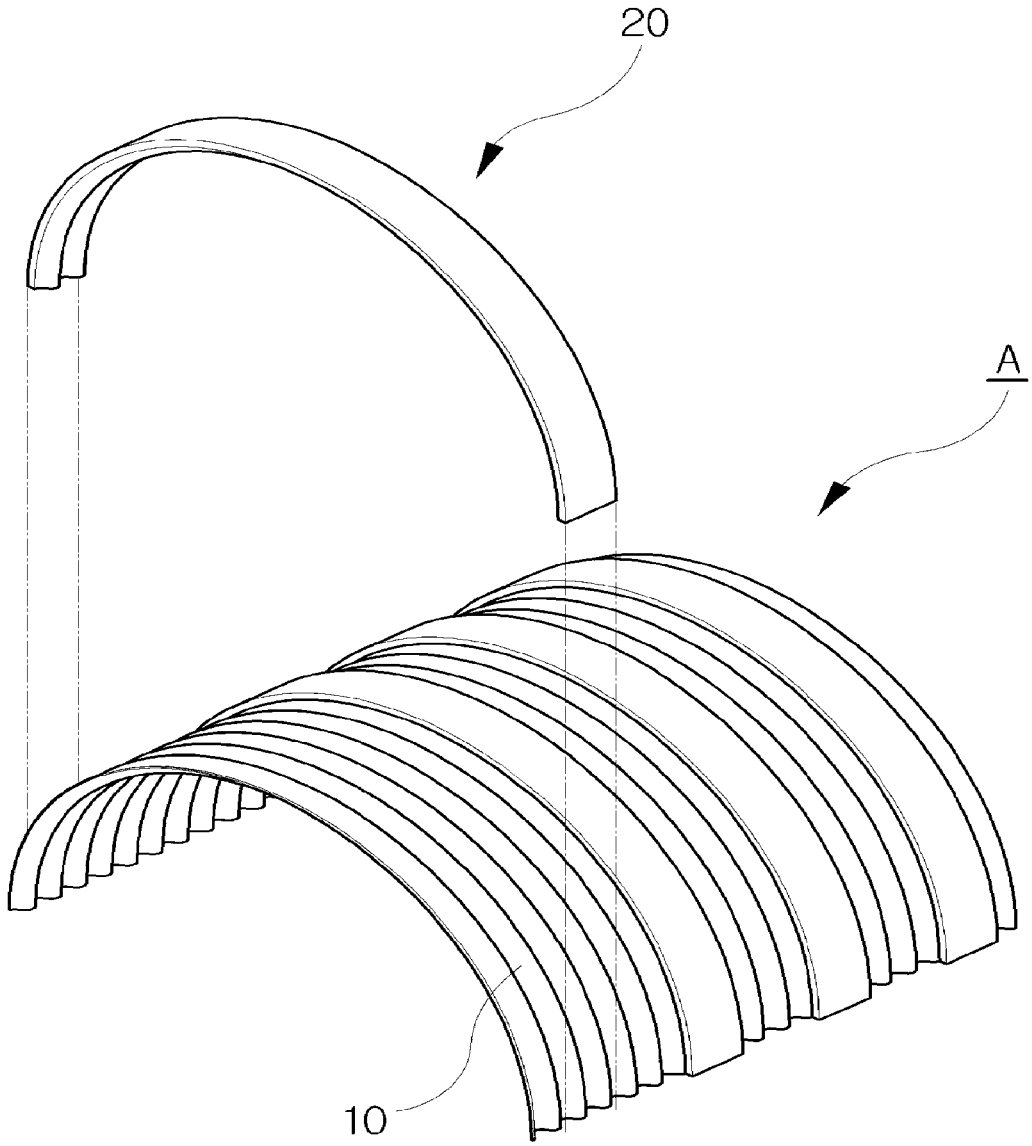
FIG. 2 is an exploded perspective view of a structure, which has been reinforced through the method of reinforcing the corrugated steel plate structure according to the present invention.

Herein below, preferred embodiments of the present invention will be described in detail with reference to the accompanying drawings.

The corrugated steel plate structure, to which the method of reinforcing the corrugated steel plate structure according to the present invention may be adapted, is produced by forming alternating furrows and ridges on a steel plate, having a predetermined thickness and width, through a crimping process, thus forming a corrugated steel plate, and by securing the corrugated steel plate to anchors and channels, which have been installed in the foundation, using bolts and nuts. Thus, a desired corrugated steel plate structure having a tunnel shape can be obtained.

The present invention increases the sectional area of the corrugated steel plate, which constitutes the tunnel-shaped structure. Thus, the present invention increases the axial strength and the bending strength of the structure, and thus a large-sized and stable structure can be provided. In the present invention, a liner 20 is provided on a surface of a corrugated steel plate 10.

To form the liner 20, a plurality of anchor bolt insert holes 13 having the same diameter is formed in the furrows 11 and the ridges 12 of the surface of the corrugated steel plate 10 through a drilling process. An anchor bolt 21, 21' is installed in each of the anchor bolt insert holes 13, which are formed in the corrugated steel plate 10, such that the upper end of the anchor bolt 21, 21' protrudes from the surface of the corrugated steel plate 10 to a predetermined height, thus laying the foundation.

Thereafter, a reinforcing bar installing step S20 is executed so as to fasten a reinforcing bar 22 to the anchor bolts 21 and 21', which protrude from the surface of the corrugated steel plate 10, using wires 23. Thus, it is possible to prevent the resulting liner 20 from being removed from the surface of the corrugated steel plate 10 and to increase the rupture strength of the liner 20. Next, a mold installing step S30 is executed to fasten a mold 30 to the anchor bolts 21 and 21' using a nut 24 such that the mold 30 covers the reinforcing bar 22, which has been installed above the surface of the corrugated steel plate 10.

Figure 6:
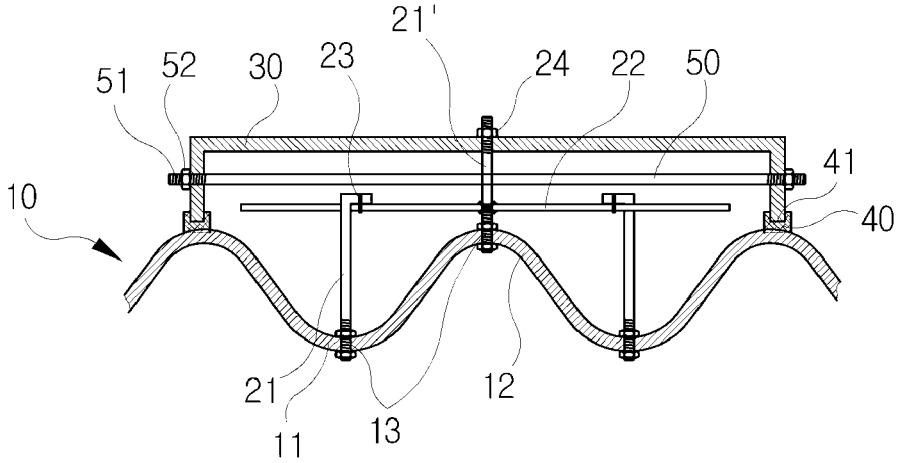
Figure 7:
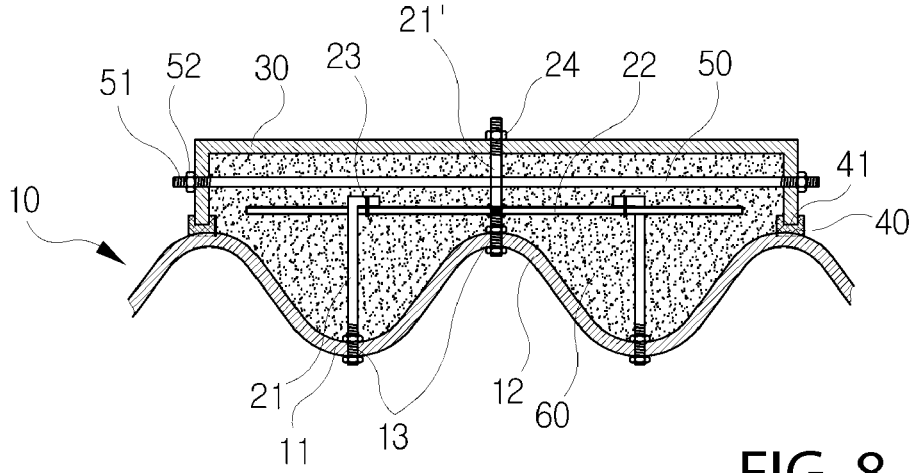
Figure 8:
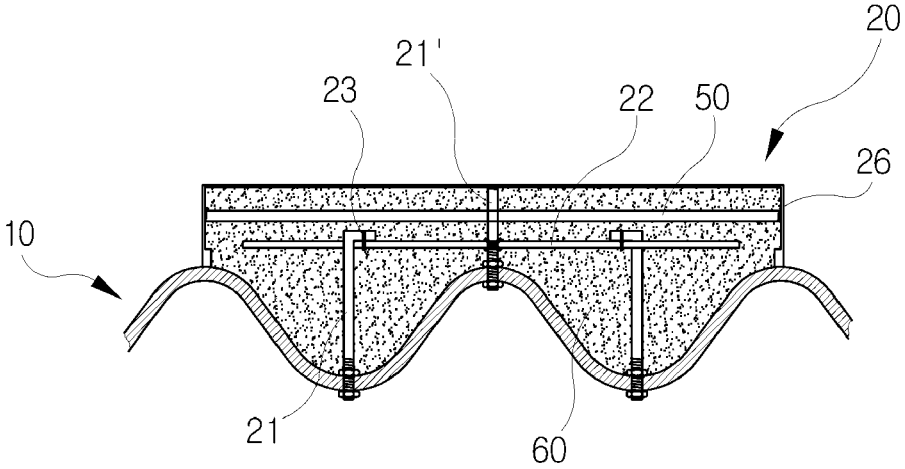

In the above state, to place concrete 60 inside the mold 30, an inlet having a predetermined diameter or a predetermined surface area must be formed in an uppermost mold 30. Further, to prevent the leakage of water from the placed concrete 60 to the atmosphere through gaps between the corrugated steel plate 10 and the mold 30, a seal 40 is preferably interposed between the surface of the corrugated steel plate 10 and the mold 30, which has been installed on the surface of the corrugated steel plate 10. The seal 40 comprises a louver having a groove 41, as shown in FIGS. 6 and 7. The grooves 41 of the louvers engage with the respective edges of the mold 30.

Further, in the mold installing step S30, the mold 30 is supported by a support bar 50, which has externally-threaded parts 51 on opposite ends thereof and is inserted into and fastened to side panels, which extend parallel to the axial direction of the corrugated steel plate 10, using locking nuts 52. Thus, the liner 20 can be prevented from being deformed at the opposite sides thereof.

Thereafter, a concrete placing step S40 is executed to place concrete 60 inside the mold 30, which has been installed on the surface of the corrugated steel plate 10. When the placed concrete 60 has cured, after the passage of a predetermined lengthy period of time, a mold removing step S50 is executed to remove the mold 30 from the cured concrete 60, and thus a concrete liner 20 having a predetermined width and height is provided along the outer surface of the corrugated steel plate 10.

When the liner 20 has sufficiently dried after the mold 30 is removed from the liner 20, waterproof paint 26 is coated on the surface of the liner 20 to a predetermined thickness, thus protecting the surface of the liner 20.

The invention claimed is:

1. A method of reinforcing a corrugated steel plate structure having alternating furrows and ridges, the reinforcing method comprising:

affixing to a surface of said corrugated steel plate structure at each one of a plurality of intervals spaced along an axial length of said corrugated steel plate structure, a discrete reinforcement liner having a predetermined length coextensive with the lengths of said alternating furrows and ridges, and a predetermined width, each said reinforcement liner being provided by, an anchor bolt installing step (S10) of forming an anchor bolt insert hole (13) through each of a plurality of furrows and/or ridges spanning a segment of said axial length of said corrugated steel plate structure shorter than the width of said liner, and installing an anchor bolt (21) in each anchor bolt insert hole (13) such that an upper end of each anchor bolt (21) protrudes from the surface of the corrugated steel plate (10) to a predetermined height;

a reinforcing bar installing step (S20) of fastening a reinforcing bar (22) to each anchor bolt (21), which protrudes from the surface of the corrugated steel plate (10), using a wire (23);

a mold installing step (S30) of mounting a mold (30) to at least one anchor bolt (21) using a nut (24) such that the reinforcing bar (22), which has been installed above the surface of the corrugated steel plate (10), is covered with the mold (30), the mold (30) having a cavity with a length parallel to said furrows and ridges and a width transverse to said furrows and ridges and less than said length so that the liner formed therein is elongated in a direction parallel to said alternating furrows and ridges of said corrugated steel plate;

a concrete placing step (S40) of placing concrete (60) inside the mold (30), which has been installed on the surface of the corrugated steel plate (10); and a mold removing step (S50) of removing the mold (30) after the concrete (60), which has been placed inside the mold (30), has been cured, wherein the mold installing step (S30) comprises: placing a seal (40) between the mold (30), which has been mounted on the surface of the corrugated steel plate (10), and the surface of the corrugated steel plate (10); and reinforcing the mold (30), which has been mounted on the surface of the corrugated steel plate (10), using a support bar (50) spanning the width of said mold with threaded parts (51) formed on opposite ends of the support bar (50) and engaging with respective locking nuts (52).

2. A structure for reinforcing a corrugated steel plate structure (A) having alternating furrows and ridges comprising a plurality of discrete reinforcement liners (20) provided at spaced intervals along a surface of said corrugated steel plate (10) having alternating furrows and ridges, each liner having a predetermined length coextensive with the lengths of said alternating furrows and ridges, and a predetermined width, and including, an anchor bolt (21, 21'), disposed in an anchor bolt insert hole (13) formed in a furrow (11) or a ridge (12) of the corrugated steel plate (10) at each of said intervals, such that a lower end of the anchor bolt (21, 21') is securely mounted in the anchor bolt insert hole (13) and an upper end of the anchor bolt protrudes outside the corrugated steel plate (10) to a predetermined length;

a concrete reinforcement (60), which has been placed and cured along an outer surface of the corrugated steel plate (10) having the protruding anchor bolt (21, 21') such that the concrete reinforcement (60) has said predetermined width and height, said width being transverse to said alternating furrows and ridges and less than a length of said concrete reinforcement (60), so that said liner is elongated in a direction parallel to said alternating furrows and ridges of said corrugated steel plate;

a reinforcing bar (22) fastened to at least one of the anchor bolts (21 and 21') using a wire (23) inside the concrete reinforcement (60);

a support bar (50) spanning the width of said liner and securely placed inside the cured concrete reinforcement (60) at a position above the reinforcing bar (22), thus being fixed by the cured concrete (60); and a waterproof paint (26) applied on an exterior surface of the concrete reinforcement (60) to a predetermined thickness.

* * * * *